US006742564B2

(12) United States Patent
Martin

(10) Patent No.: US 6,742,564 B2
(45) Date of Patent: Jun. 1, 2004

(54) SPRING FORCE SAFETY LOCKING SYSTEM FOR SECTIONAL DOORS

(75) Inventor: David O. Martin, Salt Lake City, UT (US)

(73) Assignee: Martin Door Manufacturing, Inc., Salt Lake City, UT (US)

( * ) Notice: Subject to any disclaimer, the term of this patent is extended or adjusted under 35 U.S.C. 154(b) by 16 days.

(21) Appl. No.: 10/165,005

(22) Filed: Jun. 7, 2002

(65) Prior Publication Data

US 2003/0000655 A1 Jan. 2, 2003

Related U.S. Application Data

(63) Continuation-in-part of application No. 09/547,430, filed on Apr. 12, 2000, now Pat. No. 6,401,793.

(51) Int. Cl.[7] ..... E05D 15/06

(52) U.S. Cl. ..... 160/201; 160/188; 160/189; 49/200

(58) Field of Search ..... 160/188, 189, 160/191, 192, 193, 201; 49/200, 505; 292/174, DIG. 46

(56) References Cited

U.S. PATENT DOCUMENTS

| | | | | |
|---|---|---|---|---|
| 3,788,678 A | | 1/1974 | Switzgable | 292/7 |
| 4,080,757 A | | 3/1978 | Westerman | 49/322 |
| 4,588,175 A | | 5/1986 | Martin et al. | 267/155 |
| 4,817,927 A | | 4/1989 | Martin | 267/155 |
| 5,239,777 A | | 8/1993 | Husselton | 49/200 |
| 5,240,216 A | | 8/1993 | Lin et al. | 248/300 |
| 5,246,054 A | | 9/1993 | Shepherd et al. | 160/133 |
| 5,404,927 A | | 4/1995 | Bailey | 160/201 |
| 5,419,010 A | | 5/1995 | Mullet | 16/198 |
| 5,533,561 A | | 7/1996 | Forehand, IV | 160/188 |
| 5,865,235 A | | 2/1999 | Krupke et al. | 160/191 |
| 5,964,268 A | | 10/1999 | Carper et al. | 160/191 |
| 5,967,216 A | * | 10/1999 | Mancini | 160/209 |
| 5,992,497 A | * | 11/1999 | Jaehnen et al. | 160/201 |
| 6,047,761 A | * | 4/2000 | Jaehnen et al. | 160/201 |
| 6,053,235 A | * | 4/2000 | Ruffner, Sr. | 160/89 |
| 6,082,430 A | | 7/2000 | Mock | 160/201 |
| 6,089,304 A | | 7/2000 | Mullet et al. | 160/209 |
| 6,125,582 A | | 10/2000 | Mondragon et al. | 49/200 |
| 6,126,211 A | | 10/2000 | Dominquez | 292/174 |
| 6,134,835 A | | 10/2000 | Krupke et al. | 49/200 |
| 6,145,570 A | | 11/2000 | Mullet et al. | 160/191 |
| 6,155,327 A | | 12/2000 | Wells et al. | 160/310 |
| 6,401,793 B1 | * | 6/2002 | Martin | 160/191 |
| 6,463,988 B1 | * | 10/2002 | Mullet et al. | 160/201 |
| 6,588,482 B2 | * | 7/2003 | Wright | 160/193 |
| 2003/0041980 A1 | * | 3/2003 | Schulte et al. | 160/193 |

* cited by examiner

*Primary Examiner*—Bruce A. Lev
(74) *Attorney, Agent, or Firm*—Kirton & McConkie; Berne S. Broadbent

(57) ABSTRACT

Hardware that improves safety and minimizes the risk involved in installing, maintaining, and operating sectional doors that use springs to facilitate door movement. A lock-on side bearing bracket bears up a spring on a garage door. This side-bearing bracket includes a hook and a perpendicular tab to prevent the spring from dangerously releasing its energy when parts supporting the spring are removed or fail. A lock-on bottom roller bracket having a bottom bearing plate and a safety hook similarly prevents a potential release of energy when the garage door lift cable is tensed. A curled portion at the bottom of the lift cable prevents the cable from coming off the drum. A safety latch with a latch bar and a latch cover acts as a lock for the garage door.

43 Claims, 7 Drawing Sheets

SPRING FORCE SAFETY LOCKING SYSTEM FOR SECTIONAL DOORS

RELATED APPLICATION

This application claims priority to and is a continuation-in-part of the U.S. patent application Ser. No. 09/547,430 filed Apr. 12, 2000, now U.S. Pat. No. 6,401,793 and titled SPRING FORCE SAFETY LOCKING SYSTEM FOR SECTIONAL DOORS.

BACKGROUND

1. Field of the Invention

The present invention relates generally to the field of sectional doors and related safety devices. More particularly, the present invention relates to novel hardware devices designed to improve safety and minimize the risk involved in installing, maintaining and operating sectional doors which utilize spring mechanisms to facilitate door movement.

2. Background

Large doorways in garages, shops, stores, warehouses and other buildings often use sectional doors to enclose the doorway opening. These doors are generally constructed of wood or metal panels which are joined by metal hinges and hung from metal rollers which travel along a fixed track at each side of the door. Sectional doors typically range in size from small storage unit models of just a few feet wide to very large models which accommodate trucks and heavy equipment. Sectional doors are used for residential garages where they are found in one and two car sizes.

The size of sectional doors and the weight of their materials make them relatively heavy and, therefore, difficult to lift. Many doors also contain insulation and other materials which further add to the door's weight. Even an average-sized residential garage door can weigh several hundred pounds, making it impossible for the average person to lift.

As a consequence of the weight of sectional doors, mechanisms have been invented to counteract the door's weight thereby allowing manual operation of the door. One common method of counteracting a door's weight is accomplished with a counterspring mechanism using springs which are displaced elastically as the door is shut, thereby exerting a lifting force on the door as it is closed. This spring force slows the fall of the door during closing and aids significantly in lifting the door; in effect, the door weight is balanced.

Coil springs, in a torsion spring configuration, are often used for these mechanisms. In a torsion spring configuration, the coil spring is deflected or wound around the axis of its helix. In a typical coil spring configuration, as shown in FIG. 1, one or more coil springs 2 are wound around a shaft 4 near the top of the door 6. One end of each coil spring 2 is attached to a mounting bracket 8 which is connected by screws 12 to the building structure which is typically a wooden beam 14 across the door opening. The other end of the spring is attached to a cable drum pulley 16 around which a cable 18 is wound. The cable 18 extends to the bottom of the door where it is attached with a bracket 20. These coil springs are pre-wound or pre-tensioned to increase lifting potential and ensure that the door is lifted to a fully opened position.

As the door closes, the cable unwinds from the cable drum pulley thereby twisting the spring and increasing the torsion on the spring and the energy stored within the spring. A properly adjusted spring mechanism will exert a force on a door that is about the same as the weight of the door allowing a user to open the door with the slightest of lifting effort. This means that the ideal spring mechanism, on an average door, will need to store an amount of energy that is approximately equal to the weight of the door. In terms of force and considering the lever arm of the cable drum, the spring holds a force of at least twice the weight of the door. Consequently, these spring mechanisms store a great deal of energy that is unleashed as a twisting force. Under proper operating conditions, this mechanism results in a smoothly operating door, but when poorly or improperly maintained or installed this force can be instantly unleashed in an injurious and even deadly fury.

One problem area where serious injuries can occur is at the location where the spring mounting bracket 8 attaches to the building. The spring mounting bracket is usually attached to a wood header or beam spanning across the doorway opening or vertical wood stud members.

These beams, headers or studs are typically wood members that sometimes have a relatively high moisture content at the time of construction. Over time the wood loses its natural moisture, causing shrinkage, warping or bowing of the framing members as the shrinkage pattern encounters natural inconsistencies in the grain of the wood. Cracking also results from this natural moisture loss leaving large voids in what was once solid lumber. As a result of this drying process, holes drilled for screws and mounting hardware may expand, crack and otherwise deform leaving the screws or other connectors loose and structurally weakened.

The connection to the wood support is typically made with lag screws which penetrate holes in the bracket and thread into drilled holes in the wood. This type of connection generally appears structurally sound over the short term, but problems may arise with wood shrinkage and installation problems. As the wood shrinks, the screw holes expand and the grip on the screw threads decreases and fails. Problems may also arise from installation error or misjudgment. Holes for lag screws should be drilled to an exact size to provide optimal screw capacity. When holes are over-bored to a diameter that is larger than the optimal size for the screw, the screw's holding capacity is greatly diminished. Similarly, a hole may be drilled too small or not at all which may cause the wood to crack when the lag screw is installed or a screw is inserted. Likewise, a lag screw or other fastener maybe over-tightened, causing the screw thread to twist within the hole, thereby removing some of the wood material within the hole and effectively stripping the hole interior. This also weakens the screw's holding capacity.

Often, siding material is applied to the interior face of the doorway structure to which the spring mounting bracket is attached. Generally, this siding is a gypsum-based "drywall" or "sheetrock" material that provides fire-proofing and aesthetic benefits but has very little structural strength. Screws and other fasteners which must penetrate this layer have considerably lower holding capacity due to the decreased fastener penetration into the sound structural wood below. Sometimes a piece of 2×4 or 2×6 is nailed through the sheetrock to the structure below, to which the spring mounting brackets are fastened. In this situation, the spring's torsional force is now contained only by the nails.

The problem is exacerbated by the repetitive vibration the connection must endure. The vibration and stress caused by the repeated opening and closing of the door, especially when performed by high-speed electric openers, can be an additional and significant factor in connection failure. Screw connections that are already weakened by the above-mentioned factors can vibrate loose and screws can even wiggle right out of their holes.

When the mounting bracket connection fails, the entirety of the stored torsional energy of the door spring is instantaneously unleashed, typically through uncontrolled, high-velocity spinning of the sharp-edged metal mounting bracket. When this failure occurs, any person or thing in close proximity to the bracket will be injured or destroyed. The energy of the spring mechanism is sufficient to cause severe injury and can easily maim, dismember or kill a person who is near the unit at the time of failure.

A dangerous situation often presents itself when an unwary homeowner or repairman observes loose or missing fasteners on the spring mounting bracket. Generally, the observer's reaction is to tighten the loose fasteners. This typically requires the "repairman" to climb a ladder, putting himself in very close proximity to the spring mounting bracket while tightening the loose fastener with a wrench. If the holes have expanded due to drying or have been stripped out or otherwise weakened, the attempted "tightening" will generally cause further weakening of the connection which is under spring force load often causing complete connector failure. When complete connector failure occurs, the spring force is instantly released by the wildly spinning mounting bracket immediately adjacent to the unwary, surprised and potentially badly injured "repairman."

Another safety problem occurs at the location where the cable 18 attaches to the door. This connection is typically made with a bracket 20 which is attached to the door with sheet metal screws. Like the rest of the spring mechanism, an enormous amount of energy is stored in the connection between the cable and the door. While this connection is not as prone to failure from wood deterioration or installer error, it can fail as a consequence of fatigue, improper installation, collision damage or corrosion. Common sheet metal screws are typically installed with power tools which can over-tighten and strip the metal parts they connect, leaving a weakened connection. Fatigue due to repeated stress cycles as the door opens and closes also takes a toll on the connection, especially with light gauge materials. Even when the connection is not seriously compromised, for example, in a light collision which slightly bends or breaks a bracket, an observer will have a desire to replace the damaged part, thereby exposing himself to danger. Most commonly, this danger presents itself when untrained repairmen or unsuspecting homeowners try to adjust or disconnect any part of the lift cable, bottom bracket or spring mechanism. When the majority of the cable bracket screws are removed, the lift cable can instantly fly from the door, slicing or shredding most objects in its path. Again, the full energy required to lift the heavy door around above the opening is instantly unleashed with the potential to maim or kill. Typical lift cable brackets are stamped light-gauge metal with sharp edges, further increasing the hazard.

Set screws on the spring fixtures, such as winding and stationary cones, can also be inadvertently released by a repairman or unsuspecting home owner, resulting in a similar instantaneous release of the dangerous spring energy.

SUMMARY OF THE INVENTION

The present invention reduces or eliminates the safety hazards of the prior art through the use of side mounted springs attached to lock-on side bearing brackets, tamper-resistant set screws and fasteners and lock-on bottom roller brackets which attach the lift cable to the door frame.

The problematic connection of the prior art between the mounting bracket and the building structure is eliminated by moving the coil springs to the sides of the torsion shaft above the door and attaching the springs to a bracket which is bolted to the metal track structure of the door. The track structure is screwed into the building framework, but through a much more expansive connection which avoids the concentrated, high-stress, high-torsion connection of the prior art. The preferred embodiments of the present invention incorporate multiple safety features that serve as additional safety back-ups for the systems of the present invention. Among these redundant safety features is a lock-on side bearing bracket with an inventive locking device that prevents the spring mechanism from releasing its energy even when the track and spring mechanism are entirely disconnected from the wall. Additionally, the spring mechanism energy will be retained even when the bolts holding the lock-on bearing bracket are removed. This redundant safety feature is accomplished by the use of a novel lock-on hook device which is an integral part of the bearing bracket. Many prior art side-mounted springs totally ignore safety concerns. Many of them utilize very dangerous outside lift cables which can entrap and strangle children playing with the door.

The present invention also eliminates the dangerous and problematic connection between the spring mechanism cable and the sectional door. This problem is eliminated by the use of a lock-on bottom roller bracket which is attached to the door frame with screws in a conventional manner, but which also incorporates redundant safety features. One safety feature is a lock-on bracket mechanism which hooks below the door frame, but which does not lock onto the door frame unless the attachment screws are removed or fail while tension is on the lift cable. Another safety feature is a curl located at the bottom of the lift cable which prevents the lift cable from straightening and coming off the cable drum.

The lock-on bottom roller bracket comprises a lift cable connection which uses a cable loop and clevis pin assembly. Additionally, the lock-on bottom roller bracket comprises a hook device which wraps around the bottom of the door frame and with the slightest movement prevents the bracket from being removed from the door frame while there is tension on the lift cable. The lock-on feature fastens solid only when the screws are removed while there is tension on the lift cable. The lock-on hook is designed to be free from the vertical part of the door frame unless the fasteners are removed while there is tension on the lift cable. At that point, the bottom lock-on roller bracket locks on. Further, the lock-on bottom roller bracket comprises a bottom plate which attaches below the door frame, thereby strengthening the attachment to the door and helping to prevent the bracket from instantaneously separating from the door in the case of conventional fastener failure or removal. The lock-on bottom roller bracket is designed for safer interior lift cables and may not be used as an option for dangerous outside lift cables used in some prior art designs.

BRIEF DESCRIPTION OF THE DRAWINGS

In order that the manner in which the above-recited and other advantages and objects of the invention are obtained, a more particular description of the invention briefly depicted above will be rendered by reference to a specific embodiment thereof which is illustrated in the appended drawings. With the understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF SPECIFIC EMBODIMENTS

Figure 1:
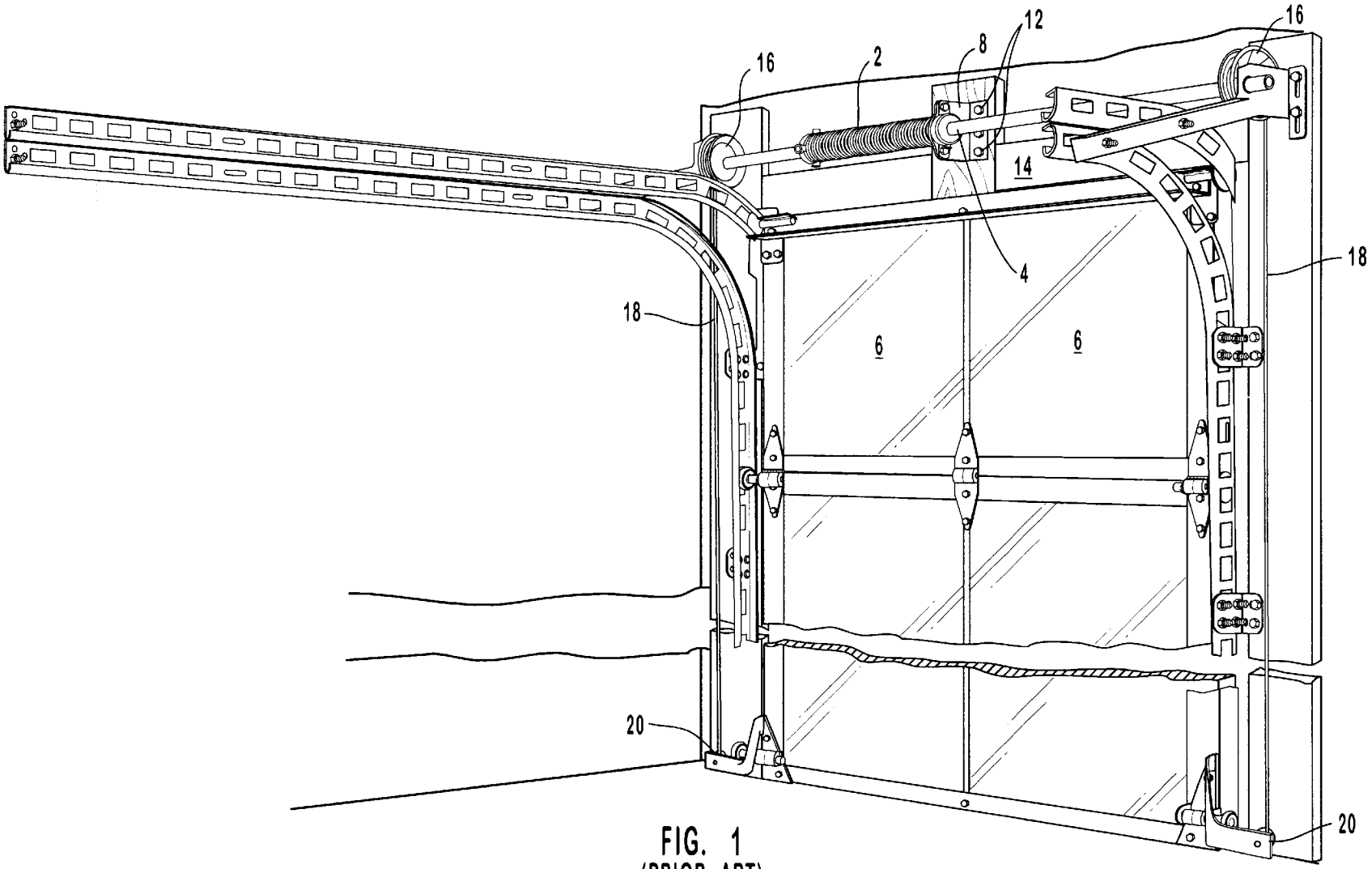
FIG. 1 (PRIOR ART)
FIG. 1 is a perspective view of a prior art sectional door assembly with a coil spring counter-spring apparatus.

The figures listed above are expressly incorporated as part of this detailed description.

It will be readily understood that the components of the present invention, as generally described and illustrated in the Figures herein, could be arranged and designed in a wide variety of different configurations. Thus, the following more detailed description of the embodiments of the system and apparatus of the present invention, as represented in FIGS. 2 through 8, is not intended to limit the scope of the invention as claimed, but is merely representative of the presently preferred embodiments of the invention.

The presently disclosed embodiments of the invention will be best understood by reference to the drawings, wherein like parts are designated by like numerals throughout.

The term "conventional fasteners" as used in this document refers to fasteners for connecting metal, wood, plastic and other materials common in sectional door construction. By way of example and not limitation, these fasteners comprise screws, bolts, nuts, washers, rivets, cotter pins, clevis pins, studs, threaded rods and other mechanical fasteners as well as adhesives such as epoxy, welding joints such as spot welds and conventional fillet and butt joint welds.

A non-fastener structure is a device that does not hold the items of its connection in a fixed physical relationship without other support, force or torque. A non-limiting example of a non-fastener structure is a hook, such as a hook which engages an element but only remains in contact with that element while a force acts on the hook, pulling it against the element.

A "torsion spring" or "torsional spring" is an element which is elastically deformed by a torque or rotational force and which counteracts against that torque with an equal, but opposite, torque. The torsion spring may provide the counteracting torque directly by virtue of its shape and configuration or it may counteract the torque indirectly through a mechanism which converts spring force into torque. By way of non-limiting example, a torsion spring may be a helically wound coil spring which is elastically deformed by a rotational motion about its helical axis, a torsion bar or a leaf spring connected to a lever and gear mechanism which creates torque.

The term "static structure" shall refer to any structure that is substantially static or immovable in response to the forces exerted by a typical sectional door. Examples of static structures, given by way of example and not limitation, are residential or commercial building frames including framing elements such as studs, posts, columns, beams, headers, lintels, stem walls, foundation structures and other elements that are assembled into a building frame. Other non-limiting examples of static structures are posts, fences, retaining walls and garden walls. These elements may be constructed of concrete, masonry, lumber, steel, plastic, fiberglass, aluminum or other materials.

The term "counter-spring" shall refer to any type of mechanism which uses elastic deformation of an element's shape to counteract a force or weight. By way of example and not limitation, a counter-spring may take the form of a coil spring from which an object is suspended or which stretches along its helical axis to support the weight of an object, thereby allowing the object to be lifted more easily. Also, by way of non-limiting example, a coil spring may be connected coaxially, in a torsion spring configuration, to a pulley or drum so that the spring rotates with the pulley or drum such that a cable wound around the pulley or drum from which an object is suspended would exert a counter-force against gravity, thereby allowing the object to be lifted with a force lesser than the weight of the object.

Figure 2:
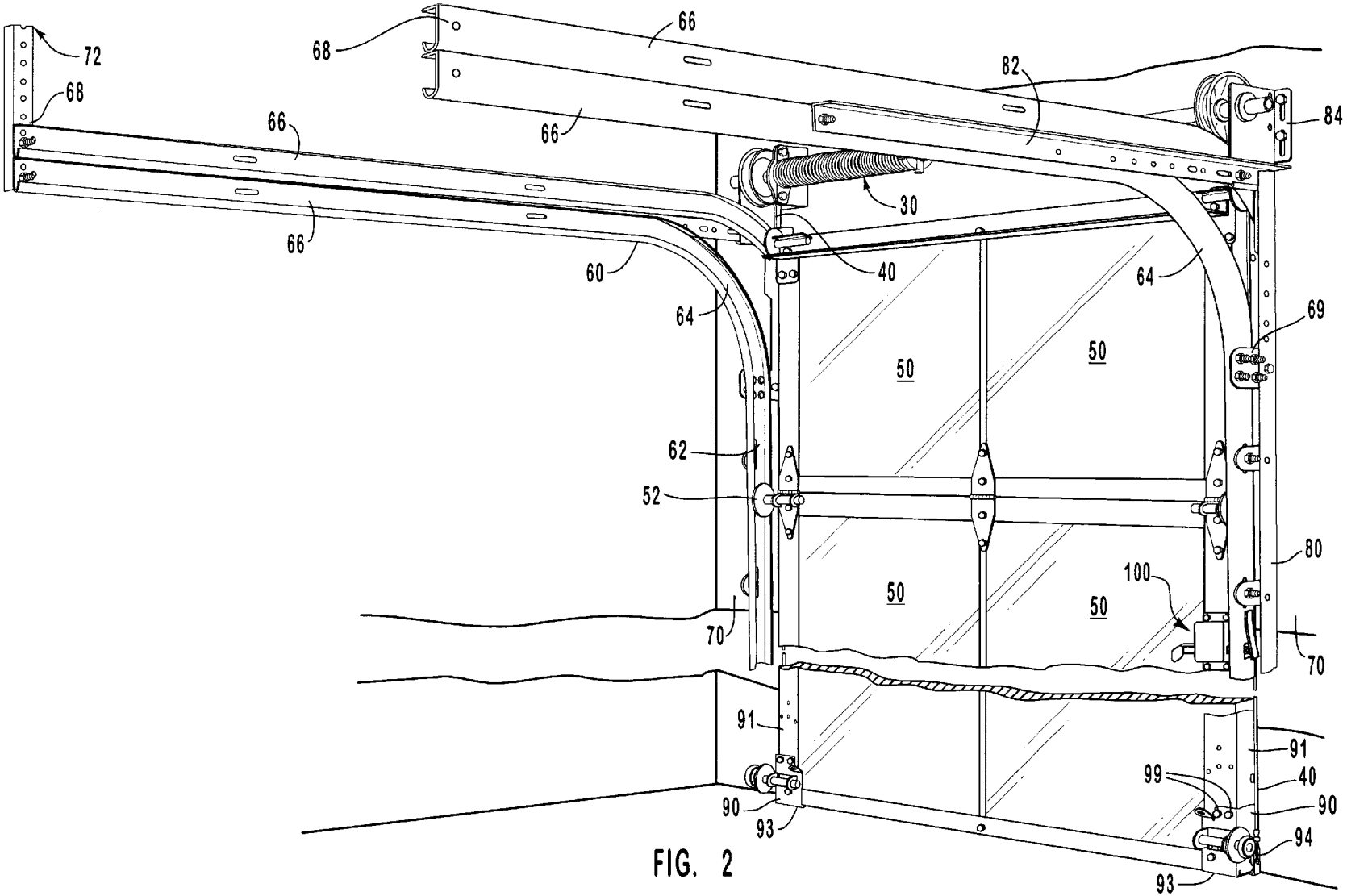
FIG. 2 is a perspective view of the inventive sectional door counter-spring system of a specific embodiment of the present invention.

A specific embodiment of the present invention, as shown in FIG. 2, comprises novel safety features for use with a spring-based system of pivotally connected sectional doors. This inventive system utilizes a torsion assembly 30 which is connected by cable 40 to sectional door 50. The roll-up door rides on rollers 52 which engage and travel within tracks 60 at each side of the door 50. These tracks typically comprise a vertical track 62, an arcuate track 64, and a horizontal track 66. Vertical track 62 is substantially parallel to door 50 when door 50 is in its closed position. Vertical track 62 is attached to wall structure 70 with a metal vertical track angle, also called a reverse angle shield 80, and bracket material using conventional fasteners such as screws, bolts, and rivets.

Horizontal track 66 is typically attached at its end 68 to a building ceiling structure 72 using metal angle and bracket material and conventional fasteners. Horizontal track 66 is typically also attached to horizontal track angle 82 which connects with vertical track angle 80 near wall structure 70. The horizontal track 66, the arcuate track 64, and the vertical track 62 are attached to the vertical track angle 80 through a connecting bracket 69 using conventional fasteners and may optionally be attached directly to the building structure. The horizontal track 66, the arcuate track 64, the vertical track 62, the vertical track angle 80, and the horizontal track angle 82 are all part of what is herein referred to as a "support track" for the sectional door 50.

Figure 3:
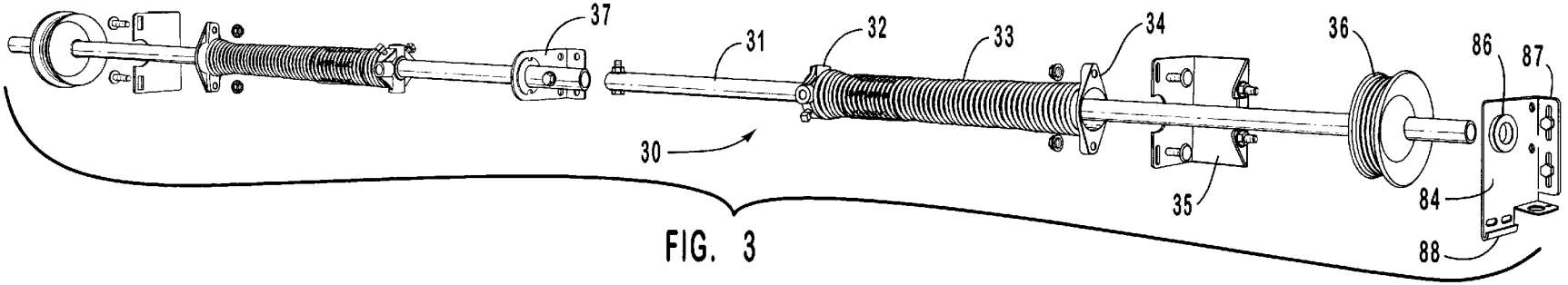
FIG. 3 is a perspective view of an inventive torsion spring assembly including a lock-on side bearing bracket of a specific embodiment of the present invention.

Torsion assembly 30, as shown in FIG. 2 and in detail in FIG. 3, comprises a torsion shaft 31 which spans between novel lock-on side bearing brackets 84 which contain bearings 86 that support torsion shaft 31 and allow torsion shaft 31 to rotate freely. While torsion shaft 31 extends the entire width of the doorway, torsion shaft 31 may have one or more sections that are connected in a manner that will allow torque to be transmitted between each section. Torsion shaft 31 may also be supported by intermediate bearing brackets 37 which contain bearings and allow torsion shaft 31 to rotate freely within the bracket bearing. Torsion assembly 30 is generally located adjacent to the wall and immediately above the doorway as shown in FIG. 2, or to the rear of the horizontal track 66 as shown in FIG. 2.

Figure 4B:
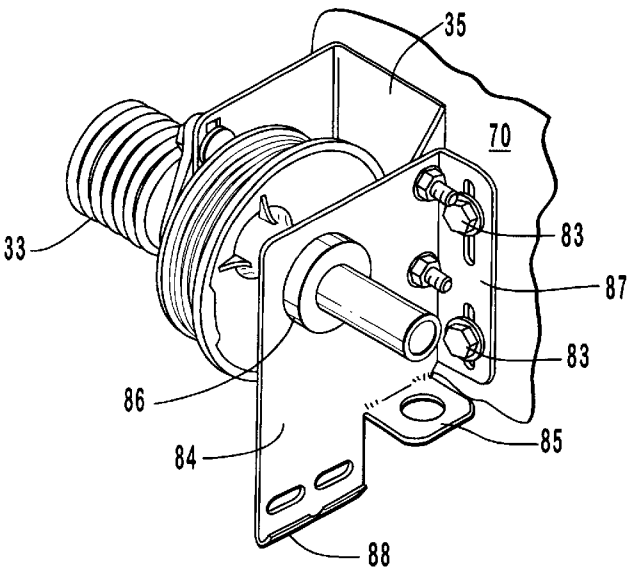
FIG. 4B is a perspective view of the inventive lock-on side bearing bracket shown with alternative redundant fasteners fastened into the adjacent wall.
Figure 4A:
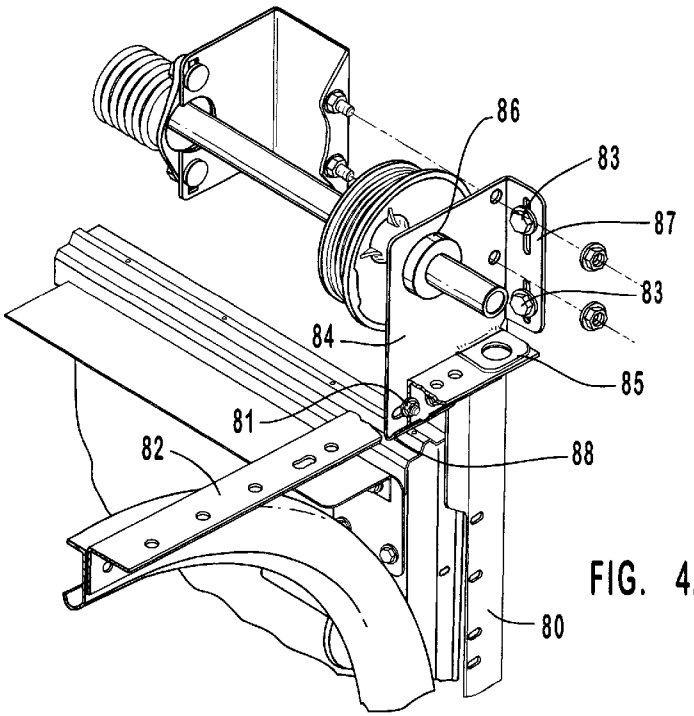
FIG. 4A is a perspective view of the inventive lock-on side bearing bracket of a specific embodiment of the present invention with a horizontal track angle cut away to show the connection between the lock-on side bearing bracket and the track angle.

Lock-on side bearing brackets 84 may attach to horizontal track angles 82 with conventional fasteners 81 (shown in FIG. 4A). Lock-on side bearing brackets 84 may also be attached to the wall structure 70 with conventional fasteners 83 such as lag screws. However, these conventional connections may fail due to the above described problems or may be inadvertently removed by an unwary and untrained "repairman." Shown in FIGS. 4A and 4B, an inventive lock-on safety hook element 88 and a shelf or torque tab 85 on the lock-on side bearing bracket 84 prevent the lock-on side bearing brackets 84 from breaking free and spinning dangerously when the conventional fasteners are removed or fail. Note that the safety hook 88 and tab 85 are shaped to fit the contour of the adjacent horizontal track angle 82.

Lock-on safety hook 88 hooks under horizontal track angle 82 and torque tab 85 bears on the top of horizontal track angle 82, thereby preventing bearing bracket 84 from rotating against the hook. As door 50 closes, lift cable 40 unwinds from cable drum 36, thereby rotating cable drum 36 which causes torsion shaft 31 to rotate, which, in turn, rotates winding cone 32 connected to spring 33 whose rotatable free end is free to rotate against the force of the spring 33. Spring anchor cone 34 holds the fixed end of spring 33 in a static position so that rotation of spring 33 will cause increased torsional force and increased stored energy in spring 33. As spring anchor cone 34 is attached to lock-on side bearing bracket 84 through spring anchor bracket 35, lock-on side bearing bracket 84 must resist the full torsional force of the spring when the door 50 is closed. This torque is transmitted to the static structure of the building through lock-on side bearing bracket 84, horizontal track angle 82, and reverse angle shield 80. If the conventional fasteners of the lock-on side bearing bracket are removed or fail, lock-on safety hook 88 bears up against the bottom of horizontal track angle 82 while torque tab 85 bears down on the top of horizontal track angle 82, thereby transmitting the full torque of spring 33 into horizontal track angle 82, which is directly and securely attached to the static structure of the building 72, through the full length of the vertical reverse angle shield 80. Consequently, the extremely high energy stored in the spring will not be inadvertently released and the bearing bracket will not spin dangerously upon anyone because the hook 88 and tab 85 structure will prevent this from occurring even when conventional fasteners are removed or fail.

Spring winding cone 32 circumscribes torsion shaft 31 and selectively locks against torsion shaft 31 to prevent rotation so that spring winding cone 32 maybe rotated to pre-tension spring 33 and may thereafter be locked against rotation so as to maintain the pre-tension force. In the preferred embodiment of the present invention, this rotational lock is a hardened, tamper-resistant steel set screw with a red safety warning cap. Coil spring 33 connects to winding cone 32 at the inner end of spring 33 with a torsionally rigid connection such that when winding cone 32 is rotated, torsion in spring 33 will increase or decrease depending on the direction of rotation. Spring 33 is also torsionally rigidly attached, at its outer end, to anchor cone 34 which is bolted to anchor bracket 35 which bends around cable drum 36 and attaches to lock-on side bearing bracket 84. Once installed, the outer end of spring 33 remains rotationally fixed to anchor bracket 35 and lock-on side bearing bracket 84 because lock-on side bearing bracket is redundantly attached to horizontal track angle 82. Cable drum 36 is torsionally rigidly attached to torsion shaft 31. Lift cable 40 winds around cable drum 36 as torsion shaft 31 is rotated.

Figure 5B:
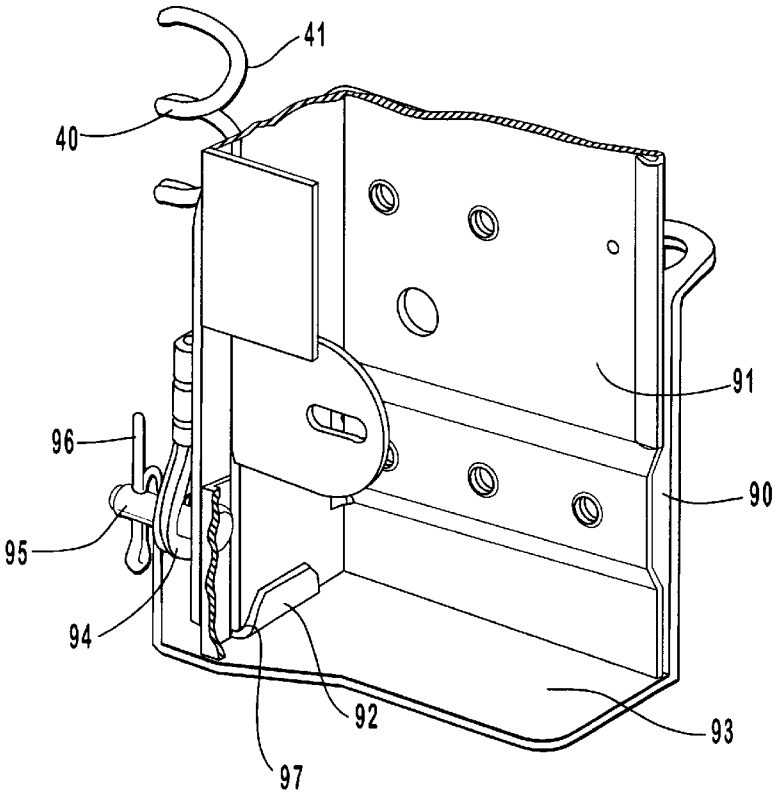
FIG. 5B is a perspective view of the inventive lock-on bottom roller bracket of a specific embodiment of the present invention as assembled with a door frame member and cable.
Figure 5A:
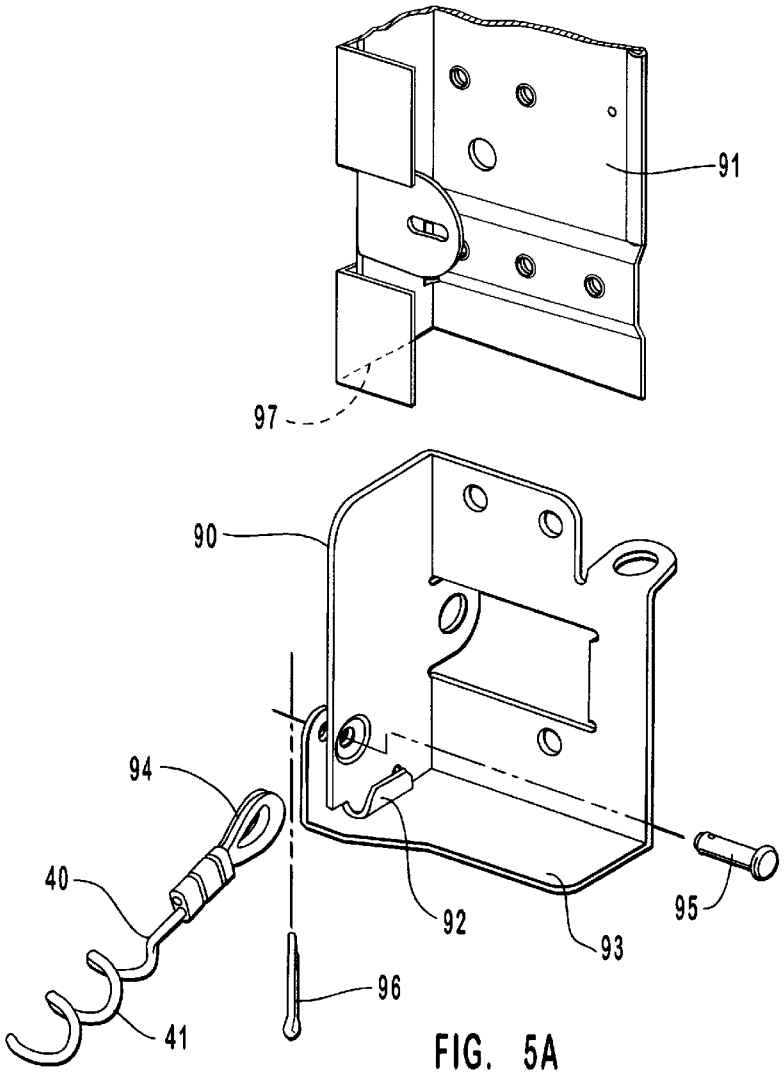
FIG. 5A is a perspective view of the inventive lock-on bottom roller bracket of a preferred embodiment the present invention shown unassembled with a door frame member.

As shown in FIGS. 5A and 5B, lift cables 40 are attached, at their lower end, to door 50, near the bottom of each side of door 50, with lock-on bottom roller brackets 90 which attach to bottom door frame members 91 with conventional fasteners as well as with an inventive safety hook 92 of the preferred embodiment of the present invention. A bottom plate 93 further increases safety by providing a bearing surface which bears against the bottom of the door 50, thereby decreasing stress on the conventional fasteners and providing another redundant mechanism for preventing dangerous separation of the lift cable 40 from door 50. Lift cable 40 is attached to lock-on bottom roller bracket 90 by a cable loop 94 which receives clevis pin 95, which, in turn, penetrates bracket 90 and is secured by cotter pin 96.

In a preferred embodiment of the present invention, lock-on bottom roller bracket 90 comprises safety hook 92 which is configured so as to engage an element 91 of door 50 in such a way that bracket 90 will not separate from door 50 or door element 91 while lift cable 40 is tensioned. While door 50 is in a closed position, lift cable 40 is substantially vertically oriented so that cable 40 exerts a vertical force on bracket 90, thereby pulling bracket 90 toward door member 91, and, if fasteners are removed, engaging safety hook 92 against door element 91. Door element 91 may be shaped with notch 97 so as to better engage hook 92. Because of the vertical force on brackets 90, the safety hook 92 will fully engage when there is inadvertent tampering or failure of fasteners 99 (see FIG. 2).

A preferred embodiment of the present invention comprises bottom plate 93 on lock-on bottom roller bracket 90. Bottom plate 93 bears on the bottom of door 50 and preferably on the bottom of door member 91, allowing a contact area between bracket 90 and door 50 which will help prevent bracket 90 from separating from door 50 in the event that the conventional fasteners therein fail or are removed. As shown at 40 in FIGS. 5A and 5B, the lift cable 40 preferably has a curled portion 41 which prevents the cable from straightening and coming off the drum 36 in the event, for example, that either the left or right side of the door 50 becomes jammed or suffers an impact.

When door 50 is in an open position with its rollers 52 resting in horizontal track 66, a substantial portion of lift cable 40 is wound around cable drum 36 and spring 33 exerts a light "pre-tensioned" torsional force on cable drum 36 which puts tension on lift cable 40, thereby holding door 50 in the upright and open position.

As door 50 is lowered toward a closed position, lift cable 40 is pulled downward, thereby rotating cable drum 36 which is rigidly fixed to torsion shaft 31. This action rotates torsion shaft 31 which rotates winding cone 32 which is rigidly attached to spring 33, causing spring 33 to rotate and increase the torsional force and energy stored therein. Subsequently, as the door 50 is lifted, spring 33 is unwound, thereby releasing energy and helping lift the door 50 by counteracting the force of gravity on the door 50.

Figure 6:
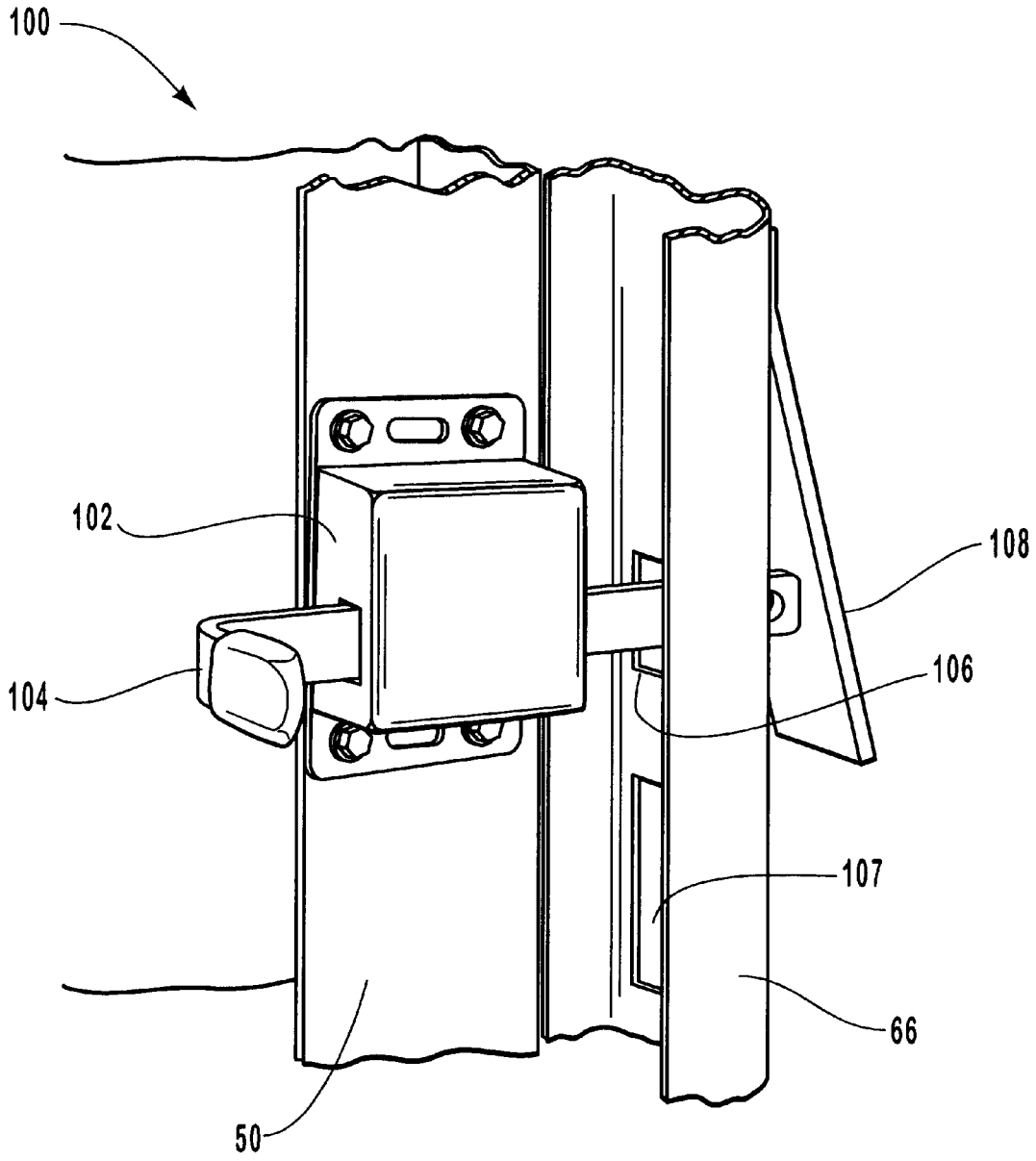
FIG. 6 is a perspective view of the inventive latch with latch aperture cover in accordance with the present invention.

FIG. 6 illustrates a perspective view of a safety latch 100 contemplated within the present invention. Latch 100, which serves as a door lock on the entire door system, includes a lock support 102, a latch bar 104, and a latch aperture 106, which is placed in rail 66 and can include other knockout apertures 107 as well. Lock support 102 mounts to the edge of door member 50 with either screws or bolts, or other appropriate fastening means. Latch bar 104 is part of lock support 102 and slides in a manner to engage latch aperture 106. Latch aperture 106 further includes a latch aperture shield 108, which is mounted in a hinged manner to support rail 66 and covers aperture 106 when latch bar 104 is disengaged. Latch aperture shield 108 prevents items from being trapped within aperture 106 during opening or closing of the door.

Figure 7:
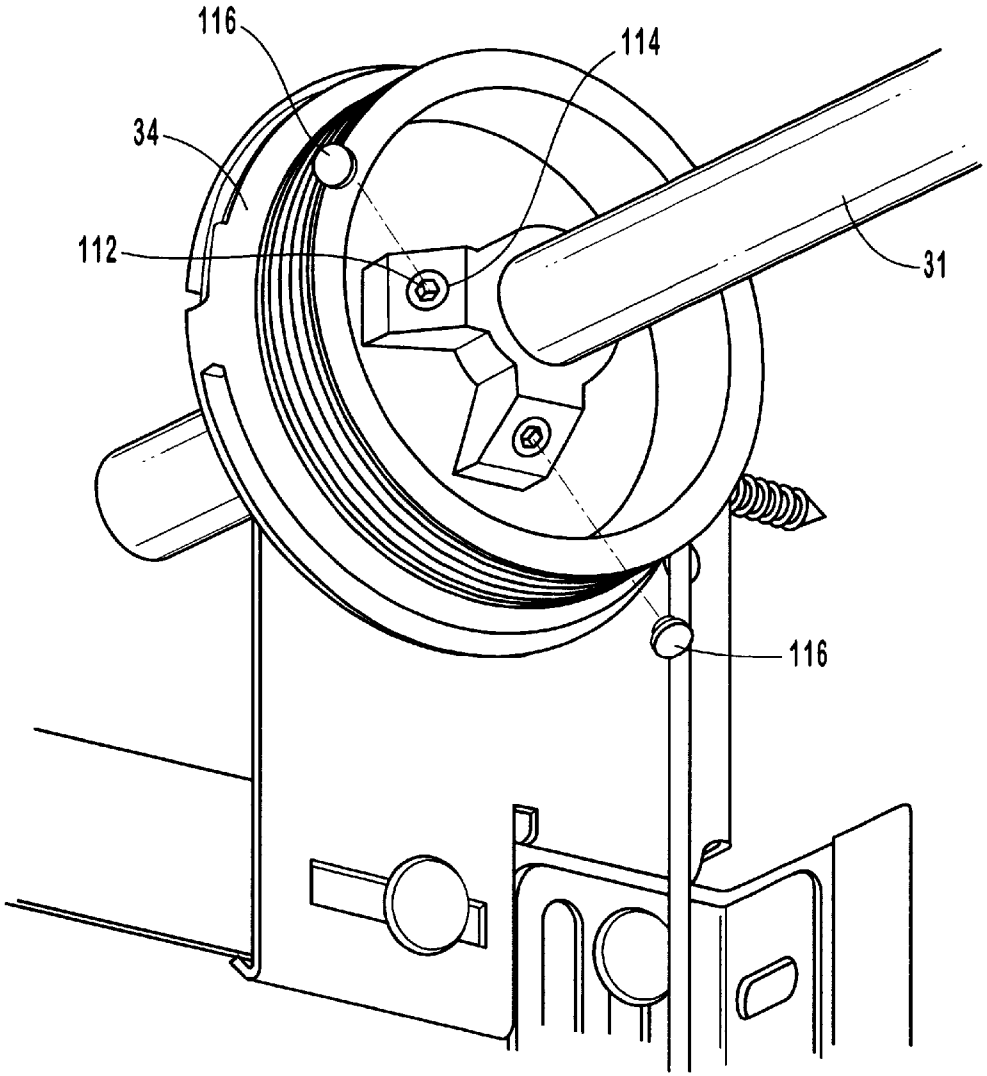
FIG. 7 illustrates a perspective view of the recessed securing screws for use with the drum in accordance with the present invention.
Figure 8:
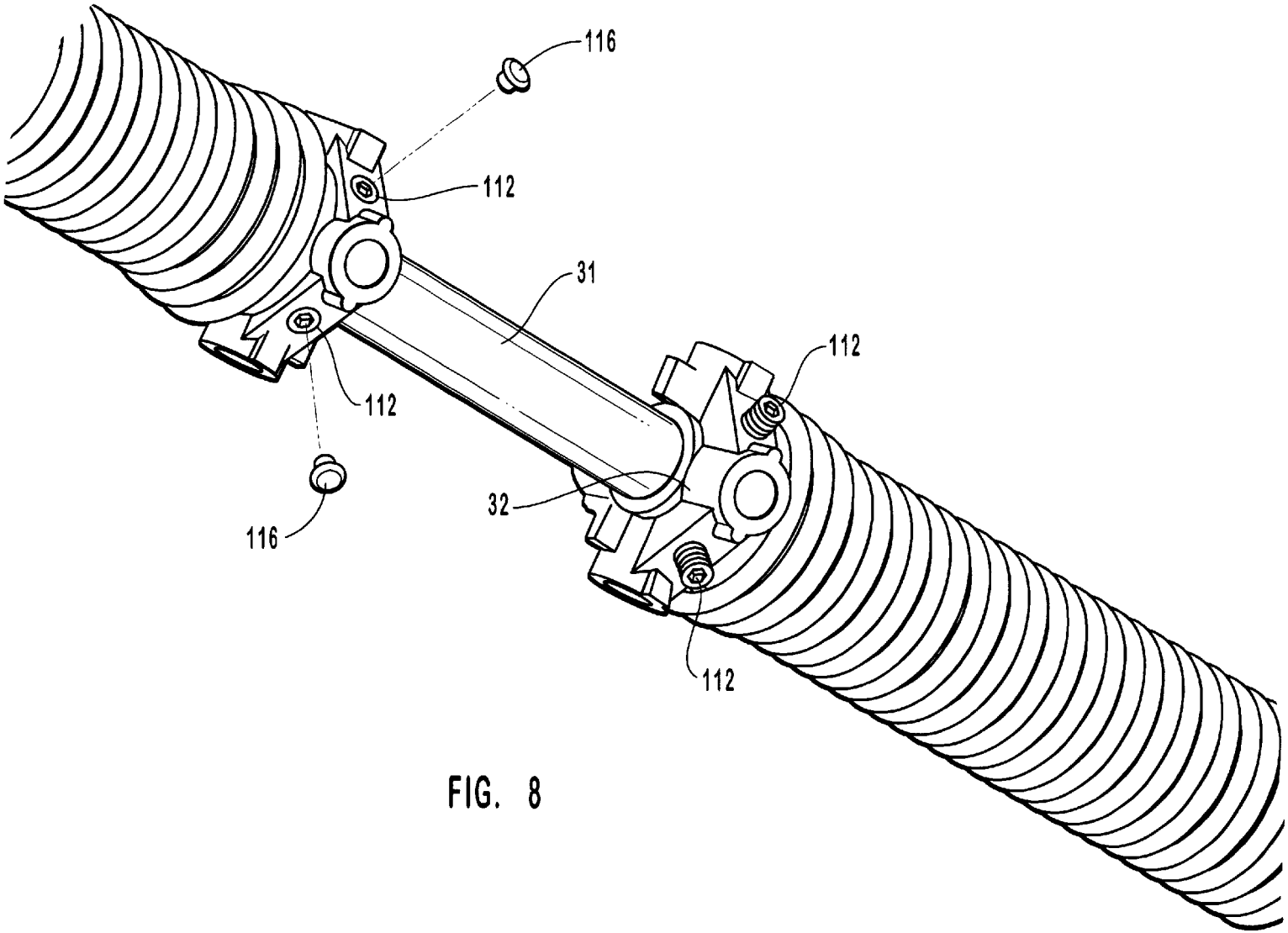
FIG. 8 illustrates a perspective view of the recessed securing screws for use with the winding cone and spring in accordance with the present invention.

FIG. 7 shows a close-up perspective view of drum 34, which mounts to rod 31. Drum 34 includes at least one retaining screw 112, which inserts through retaining aperture 114. Each retaining screw 112 engages rod 31 to prevent drum 34 from rotating independently about the rod. Also, the retaining screws 112 allow drum 34 to be removably mounted to the rod for easy repairs and installation when necessary. A similar set of retaining screws 112 are used with winding cone 32, which is illustrated in FIG. 8. The retaining screws 112 fit through another aperture to engage with rod 31. This allows the winding cone 32 to be secured between turns during installation. Also, it allows for the cone to be securely fixed to the rod for operation. Additionally, each screw 112 is shown to be a hex-driven screw. Accordingly, hex caps 116 can be placed within the hex opening of each screw 112.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed is:

1. A system comprising:

a plurality of pivotally connected sectional door panels;

a support track in which the plurality of sectional door panels travel between an open and a closed position;

a torsion spring assembly for moving the plurality of sectional door panels between said open and closed positions, said assembly including a rotatable support shaft and a torsion spring, said torsion spring having a first end and a second end, said first end being mounted to the rotatable support shaft;

a bracket coupled to said second end of the torsion spring, the bracket comprising a first surface; and a safety support extending from said bracket, the safety support being shaped to fit the contour of a portion of said support track, the safety support comprising a shelf protruding from said first surface of said bracket so that said shelf bears against said support track to prevent any tendency of the bracket to rotate with respect to the support track.

2. The system of claim 1 wherein said safety support further comprises a hook that operates together with the shelf to prevent the bracket from rotating with respect to the support track, the hook wrapping around an edge of the support track.

3. The system of claim 2 wherein said portion of the support track comprises a horizontal track angle and wherein said shelf of the safety support bears against said horizontal track angle.

4. The system of claim 1 further comprising:

a drum coupled to said support shaft; and a cable having a first end that wraps around the drum and a second end coupled to one of said sectional door panels.

5. The system of claim 4 further comprising:

a door frame member fixed to said one of said sectional door panels, the door frame member having an edge; and a cable bracket coupled to said second end of the cable and to said door frame member, the cable bracket having a hook which engages said edge of the door frame member to prevent release of the cable bracket from said door frame member while the cable is under tension.

6. The system of claim 4 wherein the second end of the cable further comprises a curled portion to prevent the cable from straightening and coming off the drum.

7. The system of claim 5 wherein the edge of the door frame member is located at the bottom of the door frame member, and the hook of said cable bracket hooks under said edge of the door frame member.

8. The system of claim 5 wherein the cable bracket further comprises a bottom bearing plate that bears up against said one of said sectional door panels while the cable is in tension.

9. The system of claim 1 wherein the bracket further comprises a hole through which the support shaft is placed.

10. The system of claim 1 wherein the support track further comprises a latch aperture placed within a portion of the support track, said latch aperture being designed to receive a latch bar mounted to one of the sectional door panels.

11. A system comprising:

a plurality of pivotally connected sectional door panels;

a support track through which the plurality of sectional door panels travel between an open and a closed position, said support track having an edge;

a torsion shaft for transmitting torque;

a torsion spring having a stationary end and a rotatable end, the rotatable end being fixed to the torsion shaft; and a lock-on side bearing bracket coupled to the stationary end of the torsion spring, said side bearing bracket having a hook and a tab that together bear against said support track to prevent rotation of said side bearing bracket with respect to the support track, said hook being wrapped under said edge of the support track, and said tab being juxtaposed against a surface of said support track.

12. The system of claim 11 wherein the support track comprises a horizontal track angle and wherein said hook and tab of the side bearing bracket bear against said horizontal track angle.

13. The system of claim 11 wherein said tab is substantially planar and extends substantially perpendicularly from the lock-on side bearing bracket.

14. The system of claim 11 further comprising a spring anchor bracket fixed to the stationary end of the torsion spring and adjacent to the lock-on side bearing bracket.

15. The system of claim 11 further comprising:

a cable drum connected to the torsion shaft such that rotation of the cable drum causes rotation of the torsion shaft and rotation of the torsion spring; and a lift cable having a first end coupled to the cable drum and a second end coupled to one of said sectional door panels.

16. The system of claim 15 further comprising:

a door frame member fixed to said one of said sectional door panels, the door frame member comprising an edge; and a cable bracket connected to said second end of the lift cable, the cable bracket having a hook which engages said edge of the door frame member to prevent, when the lift cable is under tension, the cable bracket and lift cable from disassociating with said one of said sectional door panels.

17. The system of claim 15 wherein the second end of the lift cable further comprises a curled portion to prevent the lift cable from straightening and coming off the cable drum.

18. A system comprising:

a plurality of pivotally connected sectional door panels;

a support track in which the plurality of sectional door panels travel between an open and a closed position;

a torsion spring assembly for moving the plurality of sectional door panels between said open and closed positions, said assembly including a rotatable support shaft and a torsion spring, said torsion spring having a first end and a second end, said first end being mounted to the rotatable support shaft;

a drum coupled to the support shaft of the torsion spring assembly;

a cable having a first end connected to the drum and a second end coupled to one of said sectional door panels;

a door frame member fixed to said one of said sectional door panels, the door frame member having an edge; and a cable bracket coupled to said second end of the cable and to said door frame member, the cable bracket having an upwardly curving hook which bears against said edge of the door frame member to prevent release of the cable bracket from said door frame member while the cable is under tension.

19. The system of claim 18 wherein the edge of the door frame member is situated above the hook.

20. The system of claim 18 wherein the hook wraps around the edge of the door frame member even when the cable is not under tension.

21. The system of claim 18 wherein the hook further comprises a notch specifically shaped to receive the edge of the door frame member.

22. The system of claim 18 wherein the second end of the cable further comprises a curled portion.

23. The system of claim 18 further comprising a side bracket fixed to the second end of the torsion spring, the side bracket having a safety support, said safety support comprising a hook and a tab that together bear against the support track to prevent the side bracket from moving with respect to the support track.

24. The system of claim 18 wherein said one of said sectional door panels comprises a bottom surface, and said cable bracket further comprises a bottom bearing plate that bears against said bottom surface while the cable is in tension.

25. The system of claim 18 wherein the support track further comprises a latch aperture placed within a portion of the support track, said latch aperture being formed to receive a latch bar mounted to one of the sectional door panels.

26. A system comprising:

a plurality of pivotally connected sectional door panels;

a support track in which the plurality of sectional door panels travel between an open and a closed position;

a torsion spring assembly for moving the plurality of sectional door panels between said open and closed positions, said assembly including a rotatable support shaft and a torsion spring, said torsion spring having a first end and a second end, said first end being mounted to the rotatable support shaft;

a drum coupled to the support shaft of the torsion spring assembly;

a cable having a first end connected to the drum and a second end coupled to one of said sectional door panels;

a door frame member fixed to said one of said sectional door panels, the door frame member having a bottom edge;

a cable bracket coupled to said second end of the cable, the cable bracket having a hook which moves upwardly against said edge of the door frame member to prevent, while the cable is under tension, the cable bracket and cable from disassociating with said one of said sectional door panels; and a bottom bearing plate on said cable bracket for bearing against a bottom surface on said one of said sectional door panels while said cable is in tension.

27. The system of claim 26 wherein the hook wraps under the edge of the door frame member even when the cable is not under tension.

28. The system of claim 26 further comprising a side bracket that is fixed to the second end of the torsion spring, the side bracket including a safety support comprising a hook which bears against the support track to prevent the side bracket from rotating with respect to the support track.

29. The system of claim 28 wherein said safety support further comprises a tab having a substantially planar surface that bears against the support track.

30. A system comprising:

a plurality of pivotally connected sectional door panels;

a support track in which the plurality of sectional door panels travel between an open and a closed position;

a torsion shaft for transmitting torque;

a torsion spring having a stationary end and a rotatable end, the rotatable end being fixed to the torsion shaft;

a drum coupled to the torsion shaft such that rotation of the drum causes rotation of the torsion shaft and rotation of the torsion spring;

a cable having a first end coupled to the drum and a second end coupled to one of said sectional door panels;

a door frame member fixed to said one of said sectional door panels; and a cable bracket connected to said second end of the cable, the cable bracket having a bottom bearing plate for bearing against a bottom surface on said one of said sectional door panels while said cable is under tension.

31. The system of claim 30 wherein the cable bracket is connected to the second end of the cable via a clevis pin and a cotter pin.

32. The system of claim 30 wherein the drum is removably mounted to the torsion shaft.

33. A system comprising:

a plurality of pivotally connected sectional door panels;

a support track in which the plurality of sectional door panels travel between an open and a closed position, the support track including a horizontal track angle;

a torsion shaft for transmitting torque;

a torsion spring having a stationary end and a rotatable end, the rotatable end being fixed to the torsion shaft;

a lock-on side bearing bracket coupled to the stationary end of the torsion spring, said side bearing bracket having a hook and a tab that together bear against said horizontal track angle to prevent rotation of said side bearing bracket with respect to the support track, said hook being wrapped under an edge of the horizontal track angle, and said tab being juxtaposed against a surface of said horizontal track angle;

a drum coupled to the torsion shaft such that rotation of the drum causes rotation of the torsion shaft and rotation of the torsion spring;

a cable having a first end coupled to the drum and a second end coupled to one of said sectional door panels;

a door frame member fixed to said one of said sectional door panels, the door frame member having an edge;

a lock-on bottom bracket coupled to said second end of the cable and to said door frame member, the lock-on bottom bracket having an upwardly curving hook which moves upwardly against said edge of the door frame member to prevent release of the lock-on bottom bracket from said door frame member while the cable is under tension; and a bottom bearing plate on said lock-on bottom bracket for bearing against a bottom surface on said one of said sectional door panels while said cable is in tension.

34. A method comprising:

supporting, via a support track, a plurality of pivotally connected sectional door panels;

moving, via a torsion spring and a cable, said sectional door panels between an open and a closed position;

anchoring said torsion spring with a bracket coupled to said torsion spring;

securing said bracket with a tab extending from said bracket, said tab being juxtaposed against a surface of said support track; and stabilizing said bracket with a hook that operates together with the tab to prevent the bracket from rotating with respect to the support track, the hook wrapping around an edge of the support track.

35. The method of claim 34 wherein said step of securing further comprises bearing against said surface of said support track with a substantially planar surface on said tab.

36. The method of claim 34 further comprising:

securing, via a cable bracket, one end of said cable to a door frame member that is fixed to one of said sectional door panels; and reinforcing the connection between the cable bracket and door frame member with an upwardly curving hook and a bottom bearing plate on the cable bracket, said upwardly curving hook locking on to a bottom edge of the door frame member while the cable is under tension, and said bottom bearing plate bearing against a bottom surface of said one of said sectional door panels.

37. The method of claim 36 further comprising stabilizing said cable via a curl in said end of the cable.

38. A method comprising:

supporting, via a support track, a plurality of pivotally connected sectional door panels;

securing, via a cable bracket, one end of a cable to a door frame member that is fixed to one of said sectional door panels;

lifting, via a torsion spring and said cable, said sectional door panels between an open and a closed position; and reinforcing the connection between the cable bracket and door frame member with a hook on the cable bracket, said hook locking on to a bottom edge of the door frame member while the cable is under tension.

39. The method of claim 38 further comprising preventing, via a bottom bearing plate that bears upward against a bottom surface of said one of said sectional door panels when said cable is under tension, the cable bracket from disassociating with said one of said sectional door panels.

40. The method of claim 38 further comprising stabilizing said cable via a curl in said end of the cable.

41. A method comprising:

supporting, via a support track, a plurality of pivotally connected sectional door panels;

rotating, via a torsion spring, a support shaft that, in turn, rotates a drum coupled to the support shaft;

winding, via said step of rotating, a cable around the drum, said cable having a first end connected to the drum and a second end;

lifting, via said step of rotating, said sectional door panels, said second end of the cable being coupled to a door frame member on one of said sectional door panels;

anchoring said torsion spring with a bracket coupled to said torsion spring;

securing said bracket with a tab extending from said bracket, said tab being juxtaposed against a surface of said support track;

stabilizing said bracket with a hook that operates together with the tab to prevent the bracket from rotating with respect to the support track, the hook wrapping around an edge of the support track; and reinforcing the connection between the cable bracket and said door frame member with a hook on the cable bracket, said cable bracket hook locking on to a bottom edge of the door frame member while the cable is under tension.

42. The method of claim 41 further comprising preventing, via a bottom bearing plate that bears upward against a bottom surface of said one of said sectional door panels when said cable is under tension, the cable bracket from disassociating with said one of said sectional door panels.

43. The method of claim 41 further comprising stabilizing said cable via a curl in said second end of the cable.

* * * * *